US005337664A

United States Patent [19]

Hannon

[11] Patent Number: 5,337,664

[45] Date of Patent: Aug. 16, 1994

[54] PRINTING PRESS WITH BLANKET CYLINDER THROW OFF APPARATUS AND METHOD

[75] Inventor: William G. Hannon, Westchester, Ill.

[73] Assignee: Rockwell International Corporation, El Segundo

[21] Appl. No.: 45,543

[22] Filed: Apr. 8, 1993

[51] Int. Cl.[5] ..... B41F 7/02

[52] U.S. Cl. ..... 101/218; 101/220; 101/139; 101/177; 101/180; 101/182; 101/247

[58] Field of Search ..... 101/220, 216, 218, 219, 101/247, 139, 177, 180, 181, 145, 140, 182, 184, 185

[56] References Cited

U.S. PATENT DOCUMENTS

| | | | |
|---|---|---|---|
| 3,633,503 | 1/1972 | Tafel | 101/220 |
| 4,122,772 | 10/1978 | Dahlgren | 101/218 |
| 4,218,972 | 8/1980 | Fujishiro | 101/218 |
| 4,240,346 | 12/1980 | Landis | 101/139 |
| 4,369,705 | 1/1983 | Gelinas | 101/177 |
| 4,442,773 | 4/1984 | Kobayashi | 101/218 |
| 4,458,590 | 7/1984 | Egnaczak | 101/247 |
| 4,458,591 | 7/1984 | Guaraldi | 101/247 |
| 4,875,936 | 10/1989 | Hermach | 101/221 |
| 5,161,463 | 11/1992 | Knauer et al. | 101/220 |

*Primary Examiner*—Eugene H. Eickholt

*Attorney, Agent, or Firm*—C. B. Patti; H. F. Hamann

[57] ABSTRACT

A printing press (32) with a pair of plate cylinders (12A, 12B) each having a cylindrical body (22A, 22B) and a central axis of rotation (20A, 20B) mounted in fixed parallel spaced relationship, a pair of blanket cylinders (14A, 14B) located adjacent the plate cylinders (12A, 12B) with each having a cylindrical body (30A, 30B) and a rotary axis (24A, 24B) parallel to the axes (20A, 20B) of the plate cylinders (12A, 12B), having a blanket cylinder throw off apparatus (26) mounting the blanket cylinders (14A, 14B) in an operative position in engagement with the pair of plate cylinders (12A, 12B), respectively, and with their rotary axes (24A, 24B) in lateral alignment with the axes of rotation (20A, 20B) of the plate cylinders to reduce vibration and a throw off position in which a throw off gap (39) exists between the pair of blanket cylinders (14A, 14B) and a pair of gaps (403, 43B) exist between the pair of plate cylinders (12A, 12B), respectively. A linkage assembly, including a pivotal linkage (52) connected between a relatively fixed location (56) and the rotary axes (24A, 24B) of the blanket cylinders (14A, 14B) through eccentric members (45A, 45B) automatically separates the blanket cylinders (14A, 14B) from each other to create the throw off gap (39) in response to the blanket cylinders being pivoted to the throw off position.

21 Claims, 4 Drawing Sheets

PRINTING PRESS WITH BLANKET CYLINDER THROW OFF APPARATUS AND METHOD

BACKGROUND OF THE INVENTION

1. Field of the Invention

This invention generally relates to an offset printing press and more particularly to such a printing press with a pair of blanket cylinders movably mounted by a throw off apparatus to enable separation from each other and from a pair of plate cylinders.

2. Description of the related art including information disclosed under 37 CFR 1.97–1.99

Referring to FIGS. 1A and 1B, shown is a schematic view of one end of a conventional, or prior art, offset press 10 including a pair of substantially identical plate cylinders 12A and 12B mounted for rotation about fixed axes of rotation 20A and 20B and which carry an engraved plate (not shown) of images to be printed on a web of paper 13 passing between a pair of blanket cylinders 14A and 14B. Each of the blanket cylinders 14A and 14B carry cylindrical blankets 14A' and 14B' respectively wrapped therearound. The images engraved on the plates of plate cylinders 12A and 12B are transferred as inked images to the blankets 14A' and 14B' of plate cylinder 14A and 14B The inked images carried by the blankets 14A' and 14B', in turn, are transferred to opposite sides of the paper web 13. For each of the plate cylinders 12A and 12B, there is an inking train of rollers to deliver ink to the plate cylinders 12A and 12B and a dampening train of rollers to deliver dampening liquid to the plate cylinders 12A and 12B which are conventional and therefore not shown. Those inking train rollers and dampening liquid train of rollers are in generally tandem rolling contact with each other and ultimately, at their ends, with the plate cylinders 12A and 12B and are relatively fixed and immovable during normal use of the press.

In FIG. 1A, the offset printing press 10 is shown in an operational position in which the plate cylinders 12A and 12B are in rolling transfer contact with the blankets 14A' and 14B' of the blanket cylinders 14A and 14B, respectively, and the paper web 13 is run through the contact nib between the pair of blanket cylinders 14A and 14B. During normal operation of the press 10, the blankets 14A' and 14B' must be periodically removed from the surface of the blanket cylinders 14A and 14B. When worn, the blankets 14A' and 14B' are removed and replaced. Accordingly, the pair of blanket cylinders 14A and 14B are movably mounted by means of a throw off apparatus for separation and creation of throw off gaps. Referring to FIG. 1B, a gap 41 is created between the blanket cylinders 14A and 14B and gaps 40A and 40B are created between the plate cylinders 12A and 12B and the blanket cylinders 14A and 14B, respective. The blankets 14A' and 14B' or other like blankets are mounted to and removed from through the gaps 40A, 40B and 41. Additionally, the creation of throw off gap 41 and throw off gaps 40A and 40B are needed to install and remove plates from the plate cylinders 12A and 12B and blankets 14A' and 14B' from the corresponding blanket cylinders 14A and 14B, respectively. Furthermore, a throw off gap 41 is needed to provide space between the blanket cylinders in case of a break in the web 13 during printing which consequently can lead to a web wrap-up around the blanket cylinders. The gaps provide room for the broken web to wrap and accumulate around the blanket cylinders thereby preventing possible damage to the blanket cylinders.

The throw off apparatus includes a drive linkage 15 pivotally connected to a peripheral arm of an eccentric member 44A which mounts axle 24A of the blanket cylinders 14A, and an interconnecting member 17 pivotally linking together another peripheral arm of the eccentric member 44A with a peripheral arm of another like eccentric member 44B mounting rotary axle 24B of the blanket cylinder 14B. The eccentric members 44A and 44B are mounted for rotation about fixedly mounted axes 25A and 25B, respectively, which are offset from the rotary axes 24A and 24B, respectively, of the blanket cylinders 14A and 14B.

In order to mount or dismount the blankets 14A' and 14B' when the printing press is nonoperational, the drive linkage 15 is moved by a conventional drive (not shown) to turn the eccentric members 44A and 44B in a counterclockwise direction from the operational position shown in FIG. 1A, as shown by arrows 42 and 47, FIG. 1A. This counterclockwise rotation causes the blanket cylinders 14A and 14B to move downwardly from the plate cylinders 12A and 12B and away from each other to create the necessary throw off gap 41 between the blanket cylinders and the pair of gaps 40A and 40B between blanket cylinders 12A and 12B and the pair of plate cylinders 12A and 12B, respectively.

As shown in FIGS. 1A and 1B, in the conventional printing press 10, both of the central axes of rotation 20A and 20B of the plate cylinders 12A and 12B are offset approximately thirty degrees from the blanket cylinders 14A and 14B and have axes substantially misaligned from lateral alignment with the central axes of rotation 24A and 24B of the blanket cylinders 14A and 14B. During operation, the rolling contact between the inking and dampening train of rollers and the plate cylinders 12A and 12B and between the plate cylinders 12A and 12B and movably mounted blanket cylinders 14A and 14B results in vibration between the blanket cylinders 14A and 14B and between the plate cylinders 12A and 12B and the blanket cylinders 14A and 14B, respectively. This vibration in a lateral direction generally transverse to the rotary axes results in momentary losses of proper printing pressure between the plate cylinders 12A and 12B and the blanket cylinders 14A and 14B. This vibration between the cylinders creates an uneven ink transfer from the plate cylinder to the blanket cylinder 14A and 14B. Disadvantageously, this relatively vibrational movement between the blanket cylinders 14A and 14B and the plate cylinders 12A and 12B and between the blanket cylinders 14A and 14B in the misaligned printing press 10 reduces the quality of the printed image on the paper web 13 passed between the blanket cylinders.

It is also known to have a printing press in which the axes of rotation of the blanket cylinders and the plate cylinders are substantially aligned. However, in these known printing presses at least one of the plate cylinders must be moved out of alignment in order to create a throw off gap between the blanket cylinders. Movement of a plate cylinder disadvantageously often leads to poor printing images. Moreover, in these known apparatuses a complicated and costly design is required to move the plate cylinders into and out of alignment.

SUMMARY OF THE INVENTION

It is thus the principal object of the present invention to provide a printing press and method of printing which overcomes the disadvantages of known misaligned printing presses and associated methods of printing by providing a blanket cylinder throw off apparatus and method which enables reduction of adverse effects of vibration by mounting the blanket cylinders in alignment with stationary plate cylinders.

This object of the invention is achieved in part by providing a printing press having a pair of plate cylinders with each having a cylindrical body and a central axis of rotation, means for mounting the axes of the plate cylinders in a parallel spaced relationship and a pair of blanket cylinders located adjacent the plate cylinders with each having a cylindrical body and a rotary axis parallel to the axes of the plate cylinders, with a blanket cylinder throw off apparatus comprising means for mounting the blanket cylinders in an operative position with their axes of rotation in lateral alignment with the axes of rotation of the pair of plate cylinders and with the cylindrical bodies of the blanket cylinders in abutting relationship with each other and with the pair of plate cylinders, respectively, and means for adjusting the mounting means to move the blanket cylinders to a throw off position in which both their rotary axes are out of lateral alignment with the axes of rotation of the plate cylinders to create throw off gaps between the pair of blanket cylinders and the pair of plate cylinders, respectively, while maintaining the plate cylinder in a stationary position.

Preferably, the adjusting means includes means for mounting the rotary axes for pivotal movement between alignment with the axes of rotation of the plate cylinders to throw off locations on opposite sides of lateral alignment between the axes of rotation of the plate cylinders. Means for the rotary axes of both of said blanket cylinders are pivoted about a common pivot axis located substantially midway between the axes of rotation of the plate cylinders. A linkage between the pivoting means and the blanket cylinders separates them in response to pivoting of the blanket cylinders to the nonoperative throw off position in which they are out of alignment with the axes of rotation of the plate cylinders.

The object of the invention is also partly obtained by providing a printing press, having a pair of plate cylinders with each having a cylindrical body and a central axis of rotation, means for mounting the axes of the plate cylinders in fixed, parallel spaced relationship and a pair of blanket cylinders located adjacent the plate cylinders with each having a cylindrical body and a rotary axis parallel to the axes of the plate cylinders, with a blanket cylinder throw off apparatus comprising means for mounting the blanket cylinders for movement between an operative position in which the pair of blanket cylinders are in engagement with the pair of plate cylinders, respectively, and a throw off position in which a throw off gap exists between the pair of blanket cylinders and the pair of plate cylinders, respectively, means for maintaining the plate cylinders in a stationary position when the blanket cylinders are moved from the throw off position, and a linkage assembly including a pivotal linkage between a relatively fixed location and the rotary axes of the blanket cylinders to separate the blanket cylinders from each other to create a throw off gap when the blanket cylinders are moved to the throw off position and to join the blanket cylinders to eliminate the throw off gap when the blanket cylinders are moved to the operative position.

Obtainment of the object is further achieved by providing a method of operating an offset printing press having plate cylinders and blanket cylinders, comprising the steps of (1) moving a pair of blanket cylinders to an operating position in which they are in substantial alignment with a pair of plate cylinders, (2) printing on a web passing between the blanket cylinders while the blanket cylinders are in the operating position in substantial alignment with the plate cylinders, (3) moving the blanket cylinder to a throw off position in which the blanket cylinders are misaligned with the plate cylinders to create throw off gaps that enable removal of printing blankets carried by the blanket cylinders, (4) returning the blanket cylinders to the operating position in which they are substantially aligned with the plate cylinders and (5) after the blanket cylinders are returned to the operating position in which they are again substantially aligned with the plate cylinders, operating the press to print on the web with printing blankets carried by the blanket cylinders.

Preferably, said step of moving is performed by simultaneously pivoting both blanket cylinders around a pivot axis substantially midway between the plate cylinders and the blanket cylinders are moved apart for each other in response to movement of the blanket cylinder to the throw off position.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several FIGURES of the drawing, in which.

DESCRIPTION OF THE PREFERRED EMBODIMENT

Figure 1A:
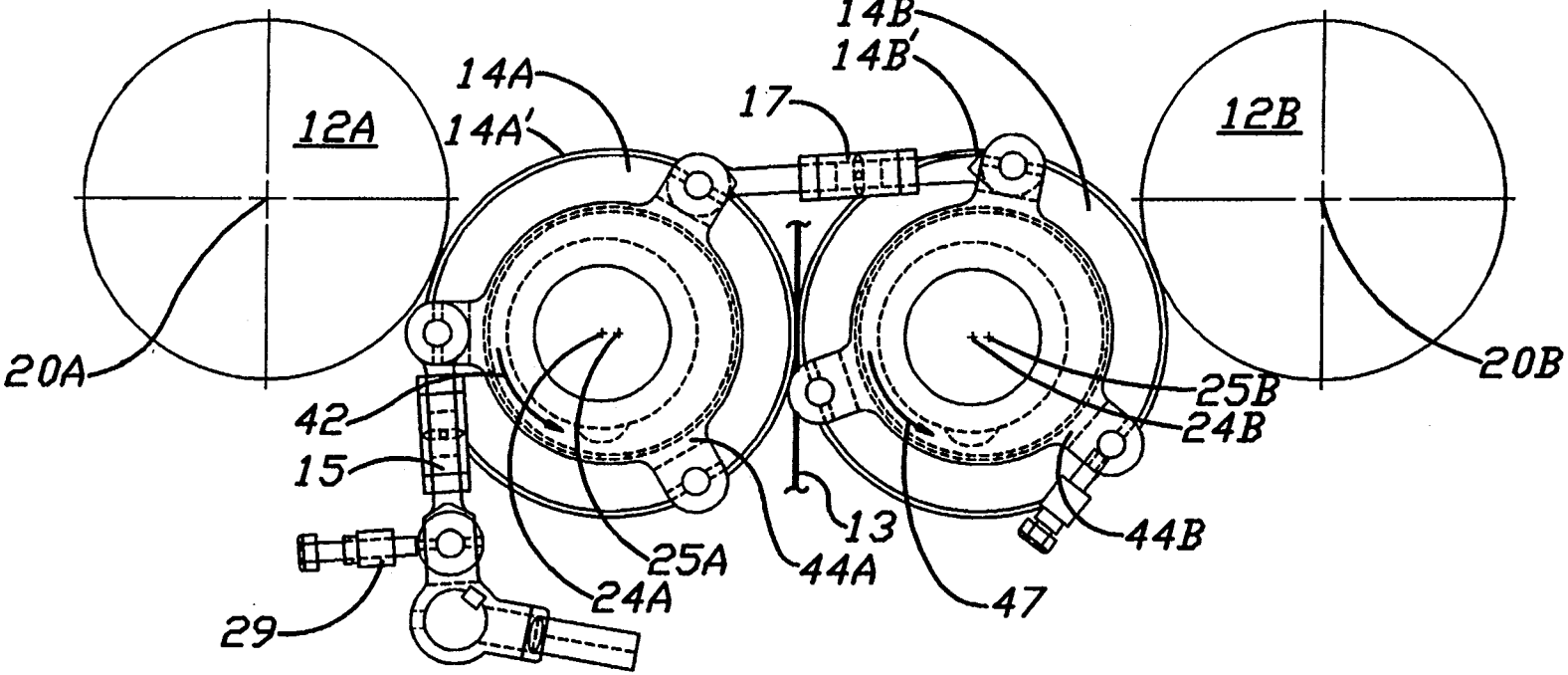
Fig. 1A PRIOR ART
FIG. 1A is a schematic side view of a conventional offset printing press of the PRIOR ART illustrating a pair of plate cylinders and a pair of blanket cylinders in the operative position.
Figure 1B:
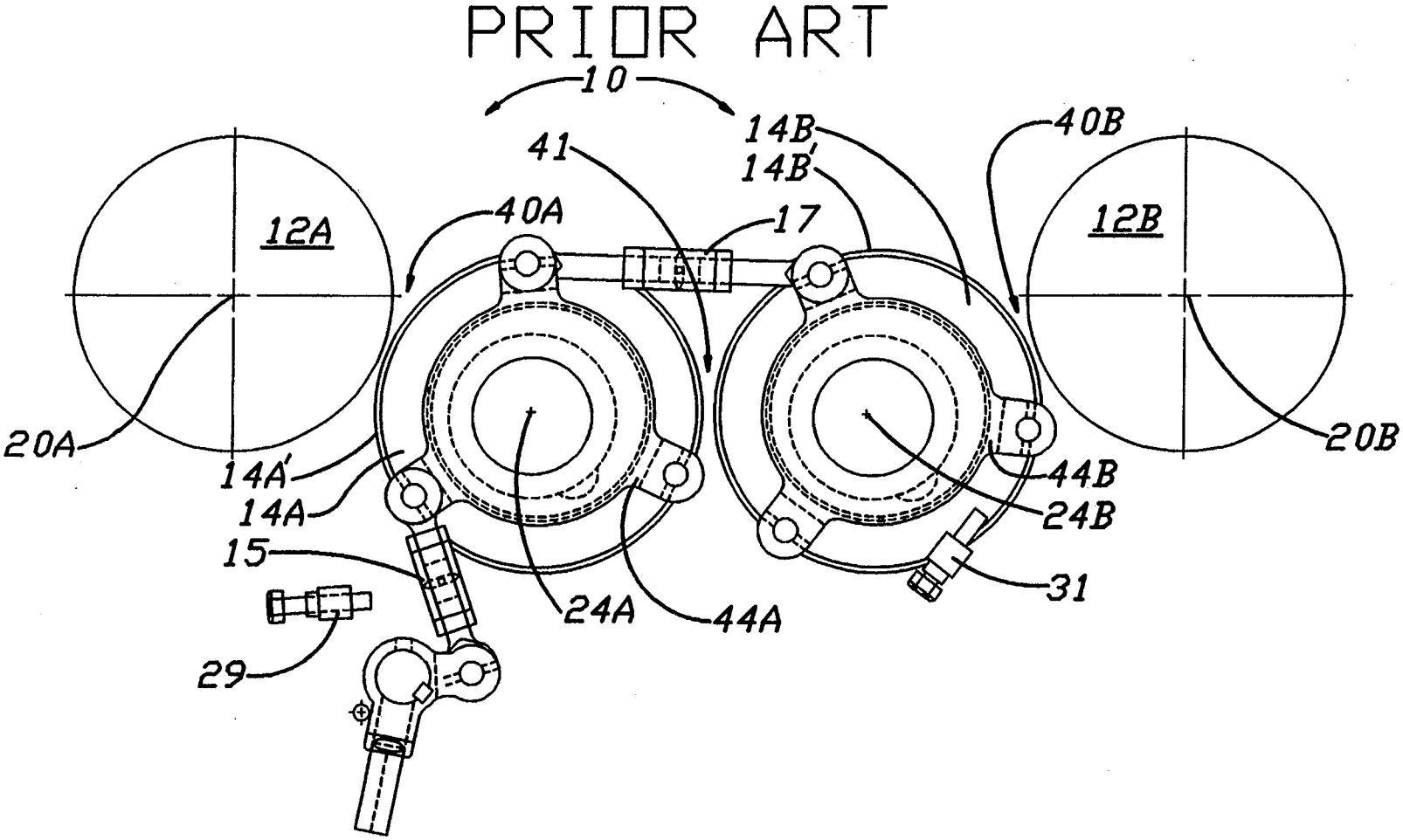
Fig. 1B PRIOR ART
FIG. 1B is a schematic end view of a conventional offset printing press of the PRIOR ART illustrating a pair of plate cylinders and a pair of blanket cylinders in an inoperative throw off position.
Figure 2A:
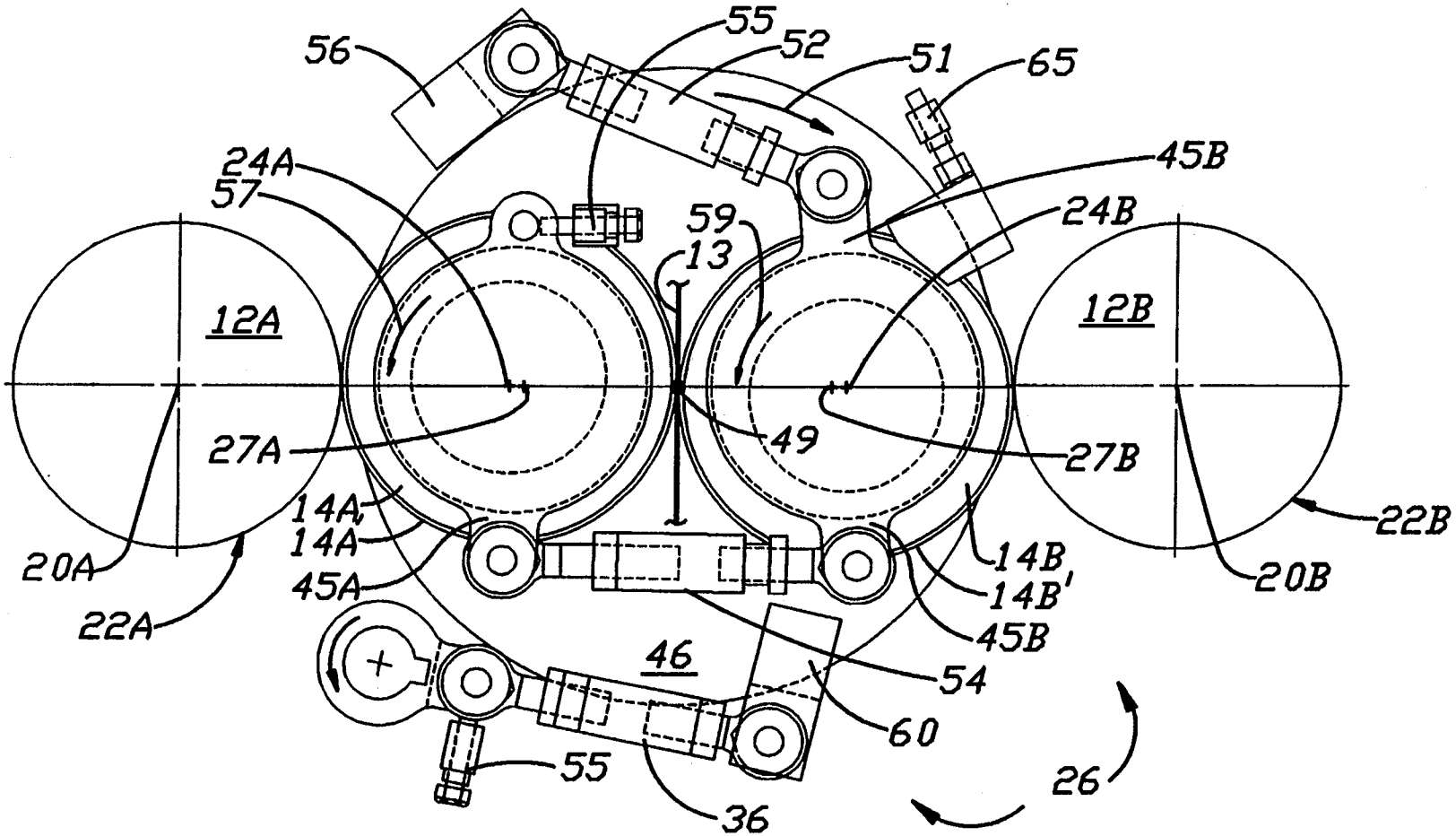
FIG. 2A is a schematic end view of the preferred embodiment of the relevant part of a printing press of the present invention which relates to the blanket cylinder throw off apparatus and a pair of blanket cylinders between the operative position in which they are aligned with the plate cylinders to reduce vibration to a throw off position.
Figure 2B:
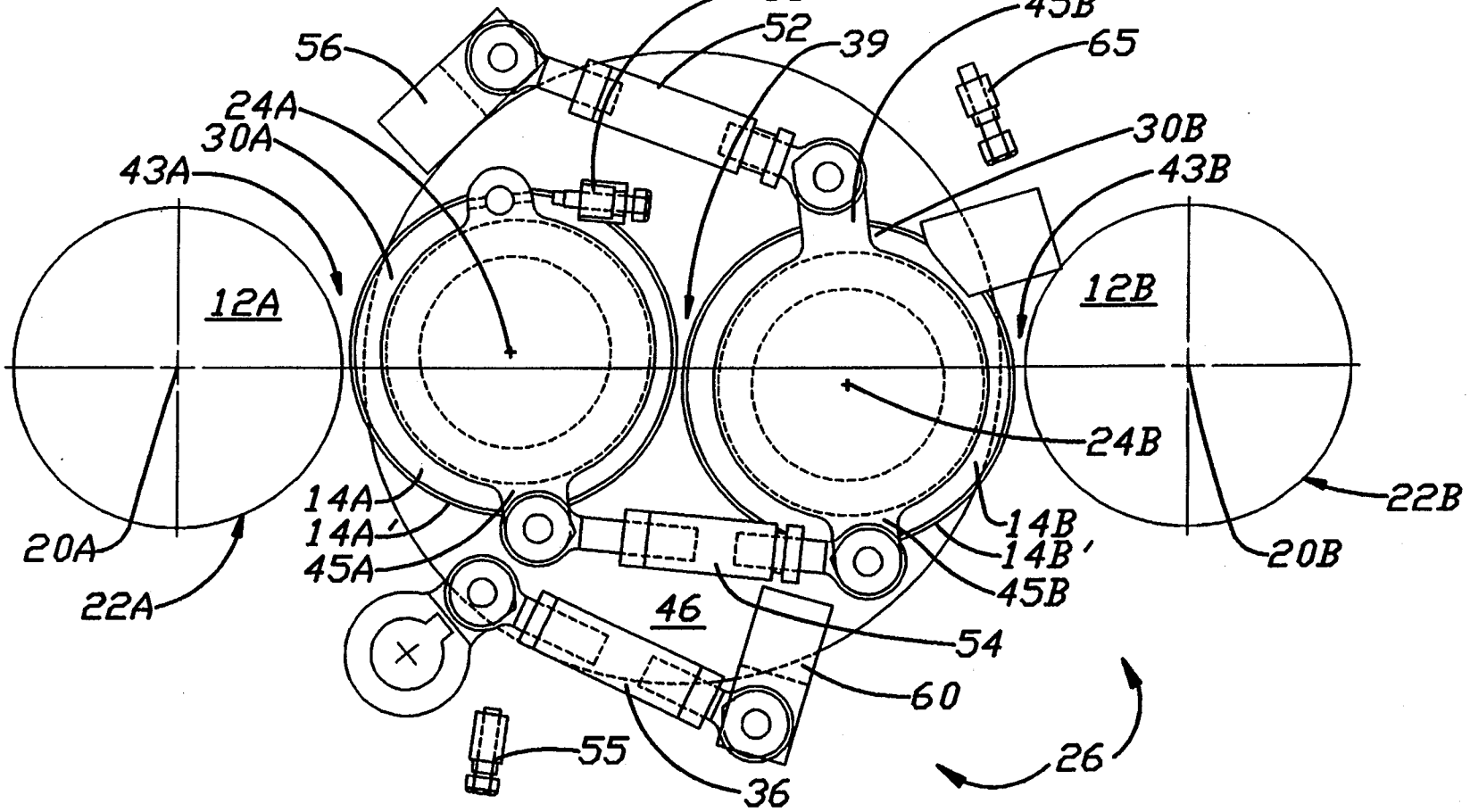
FIG. 2B is a schematic end view of the preferred embodiment of the printing press of FIG. 2A in which the throw off apparatus in the printing press has been adjusted to move the pair of blanket cylinders to throw off position.

Referring to FIGS. 2A and 2B, the preferred embodiment of the printing press 32 of the present invention is shown having a pair of plate cylinders 12A and 12B, each having a cylindrical body 22A and 22B and a central axis of rotation 20A and 20B. The axes 20A and 20B of the plate cylinders 12A and 12B are mounted in a fixed, parallel, spaced relationship in the printing press by conventional bearing frames (not shown). On opposite sides of the each of the plate cylinders 12A and 12B are an inking train of rollers and a dampening liquid train of rollers, the end rollers of which are in rolling contact with the plate cylinders at all times. These are also relatively fixedly mounted. Accordingly, the plate cylinders 12A and 12B and the distance between their cylindrical surfaces remains substantially fixed as in the conventional press 10. The blanket cylinders 14A and 14B have cylindrical bodies 30A and 30B and are mounted for rotation about rotary axes 24A and 24B which are parallel to the central axes of rotation 20A and 20B of the plate cylinders 12A and 12B, respectively. In the prior art, throw off apparatus shown in FIGS. 1A and 1B, the blanket cylinders are mounted out of alignment with the plate cylinders in order to permit pivotal movement of the blanket cylinders 14A and 14B about separate eccentric axes 25A and 25B off the surfaces of the plate cylinders 12A and 12B. Once this separation is achieved, then additional pivotal movement to separate the blanket cylinders 14A and 14B form each other is enabled. Located adjacent the plate cylinders 12A and 12B are a pair of connected blanket cylinders 14A and 14B, respectively.

In FIG. 2A, the blanket cylinders 14A, 14B are shown mounted in the operative position with a web of paper 13 passing through the blanket cylinders 14A and 14B which are in rolling contact with each other through the web 13 and with the plate cylinders 12A and 12B, respectively. In order to reduce the adverse effects of vibration, unlike the printing press of the prior art, the rotary axes 24A and 24B of the blanket cylinders 14A and 14B are mounted in substantial lateral alignment with the axes of rotation 20A and 20B of the plate cylinders 12A and 12B. As seen in FIG. 2A, the cylindrical bodies 30A and 30B, of the blanket cylinders 14A and 14B are in abutting relationship with each other and with the pair of plate cylinders 12A and 12B. It has been found that this lateral alignment of the blanket cylinders 14A and 14B with the plate cylinders 12A and 12B stabilizes blanket cylinders 14A and 14B to reduce vibration between the blanket cylinders themselves and between the blanket cylinders and their associated plate cylinders during operation.

Preferably, as will be described below, the blanket cylinders are mounted to eccentric members 45A and 45B for rotation about their rotary axes 24A and 24B. The eccentric members are mounted for rotation about eccentric axes 27A and 27B. Unlike the eccentric members 44A and 44B of the prior art printer 10 in which the arrangement of the rotary axes 24A and 24B and the eccentric axes 25A and 25B is rotary axis - pivot axis - rotary axis - pivot axis, when viewed from left to right, the relationship between the pivot axle of eccentric members 45A and 45B and the rotary axes 24A and 24B is rotary axis - pivot axis - pivot axis - rotary axis. That is, in printer 32 the pivot axes are located on the inside. This results in a different type of pivotal movement that enables a gap 39 of as great as sixty mil while a gap of only forty-five mil was obtained for the gap 41 with the throw off apparatus of the prior art printing press 10 in which, unlike the printing press 32, the pivotal motion must provide for both the gap 39 as well as the gaps 43A and 43B between the blanket cylinders and their associated plate cylinders.

This new pivotal arrangement and increased gap is possible in part because an entirely separate apparatus is provided for creating the throw off gaps 43A and 43B between the blanket cylinders 14A and 14B and the plate cylinders 12A and 12B. Preferably, this separate mechanism is a circular frame plate 46 which carries the pivot axes 27A and 27B of the eccentric members 45A and 45B and is mounted for rotation about a center axis 49 located substantially midway between the plate cylinders 12A and 12B and is laterally aligned with the pivot axes 27A and 27B. When the circular frame plate is rotated clockwise in the direction of arrow 51, the blanket cylinders 14A and 14B swing open like opposite sections of a revolving door to create gaps 43A and 43B on the order of eighty mils which is substantially larger than the approximately forty-five mil gaps created by the throw off apparatus of the printing press 10 of FIGS. 1A and 1B. Advantageously, the swinging or pivotal movement of the blanket cylinders 14A and 14B about axis 49 causes relative rotation of the eccentric members 45A and 45B in the direction of arrows 57 and 59 to create the gap 39.

The frame plate 46 is rotated in the direction of arrow 51, FIG. 1A, in order to adjust the throw off apparatus 26 to the throw off position shown in FIG. 2A. Adjustable stops 55 and 65 prevent overtravel of the throw off apparatus 26 to the operative position. In the throw off position, both of the rotary axes 24A and 24B are out of lateral alignment with the axes of rotation 20A and 20B of the stationary plate cylinders 12A and 12B. Specifically, in the preferred embodiment the rotary axes 24A and 24B are moved to opposite sides of lateral alignment between the axes of rotation 20A and 20B of the plate cylinders 12A and 12B with axis 24A being above alignment and axis 24B being an equal amount below alignment. The plate cylinders 12A and 12B are maintained in a stationary position during movement of the throw off apparatus 26 from the operative position to the throw off position. In this throw off position, throw off gaps 39 between blanket cylinders 14A and 14B and a pair throw off gaps 43A and 43B between the blanket cylinders and the pair of plate cylinders 12A and 12B, as described above, are provided.

Likewise, the rotary axes 24A and 24B of the pair of blanket cylinders 14A and 14B are carried by eccentric members 45A and 45B, respectively, on opposite sides of alignment with the center 49 of the circular frame 46 and the axes 20A and 20B. The axis of rotation 24B of blanket cylinder 14B is pivoted to a throw off location below the lateral alignment position. Likewise, the axis of rotation 24A of blanket cylinder 14A is moved to a throw off location above the lateral alignment with the axes of rotation 20A and 20B of the plate cylinders 12A and 12B. A conventional drive (not shown) moves a drive link member 36 pivotally attached to a mounting plate 60 to rotate the circular frame 46. Stop members 55 and 65 prevent overtravel of the circular frame in a rotary direction beyond a position corresponding to the operative position of the blanket cylinders 14A and 14B shown in FIG. 2A.

The eccentric members 44A and 44B carried by the circular frame 46 and mounted to the rotary axes 24A and 24B of the blanket cylinders 14A and 14B move the blanket cylinders in synchronization to create a throw off gap 39, FIG. 2B, between the blanket cylinders when the throw off gaps 43A and 43B are created between the blanket cylinders and the pair of plate cylinders 12A, 12B in response to the pivotal movement of the eccentric axes 27A and 27B about pivot axis 49. This synchronized movement is achieved by virtue of linkage assembly linked between a relative fixed location 56 and the eccentric members 45A and 45B to cause them to rotate about their axes 27A and 27B. A pivotal, adjustable linkage member 52 pivotally interconnects a relatively fixed mounted bracket 56 to a peripheral arm of the eccentric member 45B. Thus, the linkage member 52 interconnected with the fixed location 56 is directly linked to the rotary axis 24B of one of the pair of blanket cylinders 14B through the eccentric member 45B. Eccentric member 45B is pivotally connected through another pivotal, adjustable linkage member 54 a peripheral arm of eccentric member 45A. Thus, linkage 52 is linked through eccentric member 45A to the axis of rotation 24A of blanket cylinder 14A. The linkage member 52 is thus indirectly linked through the other linkage member 54 and eccentric member 45B to the rotary axis 24A of the other blanket cylinder 14A.

This linkage assembly causes the eccentric members 45A and 45B to rotate in the direction of arrows 57 and 59 to separate the blanket cylinders 14A and 14B from each other to create a throw off gap 39 when the blanket cylinders are rotated to the throw off position in the direction of arrow 51 and to join the blanket cylinders to eliminate the throw off gap when the blanket cylinders 14A and 14B are pivoted in the opposite direction. The pair of eccentric members 45A and 45B which mount the rotary axes 24A and 24B of the blanket cylinders 14A and 14B for rotary movement, selectively pivot the blanket cylinders toward and away from each other.

The removed printing blankets 14A' and 14B' are exchanged with other printing blankets when the blanket cylinders are in the throw off position. After the replacement blankets 14A' and 14B' are mounted, the circular frame 46 is moved in a counterclockwise direction opposite to that of arrow 51 relative to the blanket cylinders to the aligned operating position to print on the web 13 of paper with the exchanged or cleaned printing blankets.

While the advantages of the invention are preferably obtained with the blanket cylinder throw off apparatus 26 described above with reference to FIGS. 2A and 2B, the method of the invention can be practiced with any other offset printing press having a pair of blanket cylinders with a pair of rotary axes parallel to the axes of a pair of plate cylinders. Preferably, an offset printing press having plate cylinders and blanket cylinders is operated by (1) moving a pair of blanket cylinders to an operating position in which the blanket cylinders are in substantial alignment with a pair of plate cylinders to reduce adverse vibration (2) printing on a web passing between the blanket cylinders while the blanket cylinders are in the operating position in substantial alignment with the plate cylinders, (3) moving the blanket cylinder to a throw off position in which the blanket cylinders are misaligned with the plate cylinders to create a throw off gap that enables changing printing blankets carried by the blanket cylinders, (4) returning the blanket cylinders to the operating position in which they are substantially aligned with the plate cylinders, and (5) after the blanket cylinders are returned to the operating position in which they are substantially aligned with the plate cylinders, operating the press to print on the web with the printing blankets carried by the blanket cylinders. Preferably, the blanket cylinders are moved to a throw off position by simultaneously pivoting both blanket cylinders 14A, 14B around a pivot axis 49 substantially midway between the plate cylinders 12A and 12B, and the blanket cylinders 14A, 14B are moved apart in response to the moving of the blanket cylinder to the throw off position.

While a detailed description of the preferred embodiment of the invention has been given, it should be appreciated that many variations can be made thereto without departing from the scope of the invention as set forth in the appended claims. For instance, although it is preferred to move the blanket cylinders into and out of alignment by pivoting thereabout pivot axis 49, it should be appreciated that they could also be mounted for translational movement into and out of alignment to achieve the reduction in adverse vibration effects.

I claim:

1. In a printing press having a pair of plate cylinders with each having a cylindrical body and a central axis of rotation, means for mounting the axes of the plate cylinders in a parallel spaced relationship and a pair of blanket cylinders located adjacent the plate cylinders, with each having a cylindrical body and a rotary axis parallel to the axes of the plate cylinders, the improvement being a blanket cylinder throw off apparatus, comprising:

means for mounting the blanket cylinders in an operative position with their rotary axes in substantial lateral alignment with the axes of rotation of the pair of plate cylinders and with the cylindrical bodies of the blanket cylinders in abutting relationship with each other and with the pair of plate cylinders, respectively; and means for adjusting the mounting means to move the blanket cylinders to a throw off position in which both their rotary axes are out of lateral alignment with the axes of rotation of the plate cylinders to create throw off gaps between the pair of blanket cylinders and the pair of plate cylinders, respectively, while maintaining the plate cylinders in a stationary position.

2. The printing press of claim 1 in which the adjusting means includes means for mounting the rotary axes for pivotal movement between substantial alignment with the axes of rotation of plate cylinders to throw off locations on opposite sides of lateral alignment between the axes of rotation of the plate cylinders.

3. The printing press of claim 2 in which said pivotal mounting means includes means for pivoting the rotary axes of both of said blanket cylinders about a common pivot axis located substantially midway between the axes of rotation of the plate cylinders.

4. The printing press of claim 3 in which said adjusting means includes means associated with the pivoting means to prevent overtravel beyond a position corresponding to the operative location for the blanket cylinders.

5. The printing press of claim 2 in which said pivotal mounting means includes a rotatable frame with a center, and means for carrying the rotary axes of the pair of blanket cylinder on opposite sides of the center, and means for rotating the rotatable frame around its center between an operating position in which the blanket cylinders are in their operative position and a nonoperating position in which the blanket cylinders are in the throw off position.

6. The printing press of claim 5 including a stop member carried by the circular frame to prevent overtravel in a rotary direction beyond a position corresponding to the operative position of the blanket cylinders.

7. The printing press of claim 5 includes means linked to the rotary axes of the blanket cylinders and the circular frame for separating them while being pivoted to the nonoperating position.

8. The printing press of claim 7 in which the blanket cylinder separating means includes an eccentric member to pivotally separate the blanket cylinders in response to rotation of the circular frame.

9. The printing press of claim 2 including means linked to the pivoting means and the blanket cylinders to separate them in response to pivoting of the blanket cylinder to a nonoperative position out of alignment with the axes of rotation of the plate cylinders.

10. The printing press of claim 9 in which said linked means includes eccentric members for mounting the rotary axes of the blanket cylinders.

11. The printing press of claim 1 including eccentric members for mounting the rotary axes of the blanket cylinders for separating movement to create a throw off gap therebetween.

12. The printing press of claim 11 including means for linking the eccentric members to the adjusting means to move in synchronization to create a throw off gap between the blanket cylinders when a throw off gap is created by the adjusting means between the pair of blanket cylinders and the pair of plate cylinders, respectively.

13. The printing press of claim 1 including a linkage assembly including a linkage member pivotally interconnected between a relatively fixed location and the rotary axes of the blanket cylinders to respectively separate and join the blanket cylinders when moved to the throw off and operative positions, respectively.

14. The printing press of claim 13 in which said linkage member interconnected with the fixed location is directly linked to the rotary axis of one of the pair of blanket cylinders and indirectly linked to the rotary axis of the other of the pair of blanket cylinders through another linkage member.

15. In a printing press having a pair of plate cylinders with each having a cylindrical body and a central axis of rotation, means for mounting the axes of the plate cylinders in fixed, parallel spaced relationship and a pair of blanket cylinders located adjacent the plate cylinders, with each having a cylindrical body and a rotary axis parallel to the axes of the plate cylinders, the improvement being a blanket cylinder throw off apparatus, comprising:

a circular frame having a rotary axis substantially laterally aligned with the axes of the plate cylinders;

means for mounting the blanket cylinders to the circular frame for movement between an operative position in which the pair of blanket cylinders are in engagement with the pair of plate cylinders, respectively, and a throw off position in which a throw off gap exists between the pair of blanket cylinders and the pair of plate cylinders, respectively;

means for maintaining the plate cylinders in a stationary position when the blanket cylinders are moved to the throw off position; and a linkage assembly including a pivotal linkage between a relatively fixed location and the rotary axes of the blanket cylindes to separate the blanket cylinders from each other to create a throw off gap when the circular frame is rotated to the throw off position and to join the blanket cylinders to eliminate the throw off gap when the circular frame is rotated to the operative position.

16. In a printing press having a pair of plate cylinders with each having a cylindrical body and a central axis of rotation, means for mounting the axes of the plate cylinders in fixed, parallel spaced relationship and a pair of blanket cylinders located adjacent the plate cylinders, with each having a cylindrical body and a rotary axis parallel to the axes of the plate cylinders, the improvement being a blanket cylinder throw off apparatus, comprising:

means for mounting the blanket cylinders for movement between an operative position in which the pair of blanket cylinders are in engagement with the pair of plate cylinders, respectively, and a throw off position in which a throw off gap exists between the pair of blanket cylinders and the pair of plate cylinders, respectively;

means for maintaining the plate cylinders in a stationary position when the blanket cylinders are moved to the throw off position; and a linkage assembly including a pivotal linkage between a relatively fixed location and the rotary axes of the blanket cylinders to separate the blanket cylinders from each other to create a throw off gap when the blanket cylinders are moved to the trow off position and to join the blanket cylinders to eliminate the throw off gap when the blanket cylinders are moved to the operative position including and a linkage member interconnecting the rotary axes of the blanket cylinders.

17. The printing press of claim 15 in which said linkage assembly includes eccentric members for mounting the rotary axes, and means for mounting the eccentric members for rotary movement about eccentric axes to selectively pivot the blanket cylinders toward and away from each other.

18. The printing press of claim 17 in which said blanket cylinder mounting means includes means for pivoting eccentric axes of the eccentric members about a pivot axis approximately midway between the axes of rotation of the plate cylinders.

19. A method of operating an offset printing press having blanket cylinders mounted to a circular frame, each blanket cylinder having a rotary axis, comprising the steps of:

moving the circular frame to an operating position in which the rotary axes of the blanket cylinders are in substantial lateral alignment with rotary axes of a pair of plate cylinders;

printing on a web passing between the blanket cylinders while the circular frame is in the operating position;

rotating the circular frame to a throw off position in which the rotary axes of the blanket cylinders are laterally misaligned with the rotary axes of the plate cylinders to create throw off gaps that enable changing printing blankets carried by the blanket cylinders replacing the printing blankets with other printing blankets;

returning the circular frame to the operating position; and after the circular frame is returned to the operating, operating the press to print on the web with other printing blankets carried by the blanket cylinders.

20. The method of claim 19 in which said step of rotating the circular frame includes the step of simultaneously pivoting both blanket cylinders around a pivot axis substantially midway between the plate cylinders.

21. The method of claim 19 in which the step of rotating the circular frame includes the step of moving the blanket cylinders apart in response to movement of the circular frame to the throw off position.

* * * * *